US007435130B2

(12) United States Patent
Shen et al.

(10) Patent No.: US 7,435,130 B2
(45) Date of Patent: Oct. 14, 2008

(54) ELECTRICAL CONNECTOR WITH IMPROVED CONTACTS

(75) Inventors: Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/796,344

(22) Filed: Apr. 27, 2007

(65) Prior Publication Data

US 2007/0254507 A1 Nov. 1, 2007

(51) Int. Cl.
*H01R 12/24* (2006.01)

(52) U.S. Cl. ..... 439/495; 439/260

(58) Field of Classification Search ..... 439/495, 439/492–494, 260, 331
See application file for complete search history.

(56) References Cited

U.S. PATENT DOCUMENTS 5,842,883 A 12/1998 Igarashi et al.
5,904,589 A 5/1999 Asakawa
6,790,074 B1 * 9/2004 Chiu ..... 439/495
6,921,274 B2 * 7/2005 Yu ..... 439/260
6,949,316 B2 * 9/2005 Aoki ..... 439/260
2005/0208824 A1 * 9/2005 Kayama et al. ..... 439/495
2006/0094288 A1 * 5/2006 Yokoo et al. ..... 439/495
2006/0172590 A1 * 8/2006 Yamada et al. ..... 439/495
2007/0134975 A1 * 6/2007 Shin ..... 439/495

* cited by examiner

*Primary Examiner*—Hien Vu
(74) *Attorney, Agent, or Firm*—Wei Te Chung

(57) ABSTRACT

An electrical connector comprises an insulated housing (1) comprising a receiving cavity (10), a flat surface (150) and a plurality of channels (14) recessed from the flat surface to be in communication with the receiving cavity; and a plurality of contacts (2) retained in the housing, each contact having a contact beam (21) extending along the channel and having a contact portion (210) at its distal end, the contact portion comprising a contact section exposed to the receiving cavity, a shadow surface (213) located opposite to the contact section to neighbor on the channel, an inclined section (211) extending forward from the contact section and an arced section (212) connecting the inclined section with the shadow surface, the distance from circle center of the arced section to the shadow surface is shorter than radius of the arced section.

2 Claims, 9 Drawing Sheets

ELECTRICAL CONNECTOR WITH IMPROVED CONTACTS

BACKGROUND OF THE INVENTION

1. Field of the Invention

The present invention is generally related to the art of electrical connectors, and more particularly, to an electrical connector used for connecting electronic components.

2. Description of Related Art

A conventional electrical connector for connection with a flexible printed circuit (FPC) is disclosed by U.S. Pat. No. 5,842,883. The connector comprises an insulated housing, a plurality of contacts disposed on the housing and a pressing member pivotally assembled on the housing. The housing defines a receiving cavity extending along a longitudinal direction and a plurality of channels for receiving said contacts therein. Each contact has a contact beam with a contact portion exposed to the receiving cavity for electrically connecting with the FPC and a pivot beam with a pivot portion at its distal end extending substantially parallel to the contact beam. The pivot portions of the contacts engage with the pressing member after the pressing member being assembled on the housing. The head of the contact beam adjacent to the contact portion is designed to be a semicircle shape. Due to continuing trend toward miniaturization of the electronic devices with the rapid development of the electronic technology, requirements for smaller connector size and greater contact density are constantly being promulgated. However, in order to achieve a stable engagement between contact portion and the FPC, the housing must set much more space for accommodating the contact beams with the semicircle heads when the contacts are pressed to be elastically distorted by the pressing member. As a result, the connector with the contacts having semicircle heads cannot meet the requirement of miniaturization.

Another convention connector for connecting with an FPC is disclosed by U.S. Pat. No. 5,904,589. This connector is configured differently from the above-mentioned connector. The difference is that the heads of the contact beams of the contacts are designed to have a triangle shape resulting the FPC being easily inserted into the housing. However, as the contacts are constructed by stamping from a metal plate, this configuration of contacts brings another problem that contacts have many burrs on their cutting edges.

Therefore, a new electrical connector is desired to overcome the disadvantages of the prior art connectors.

SUMMARY OF THE INVENTION

Accordingly, an object of the present invention is to provide an electrical connector with a plurality of high-performance contacts which can meet miniaturization requirement.

In order to achieve the object set forth, an electrical connector is provided. The electrical connector comprises an insulated housing having a pair of sidewalls opposite to each other and a receiving cavity formed between the sidewalls, one sidewall having a flat surface and a plurality of channels recessed from the flat surface to be in communication with the receiving cavity; and a plurality of contacts retained in the housing, each contact having a contact beam extending along the channel and having a contact portion at its distal end, the contact portion comprising a contact section exposed to the receiving cavity, a shadow surface located opposite to the contact section to neighbor on the channel, an inclined section extending forward from the contact section and an arced section connecting the inclined section with the shadow surface, the distance from circle center of the arced section to the shadow surface is shorter than radius of the arced section.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 3:
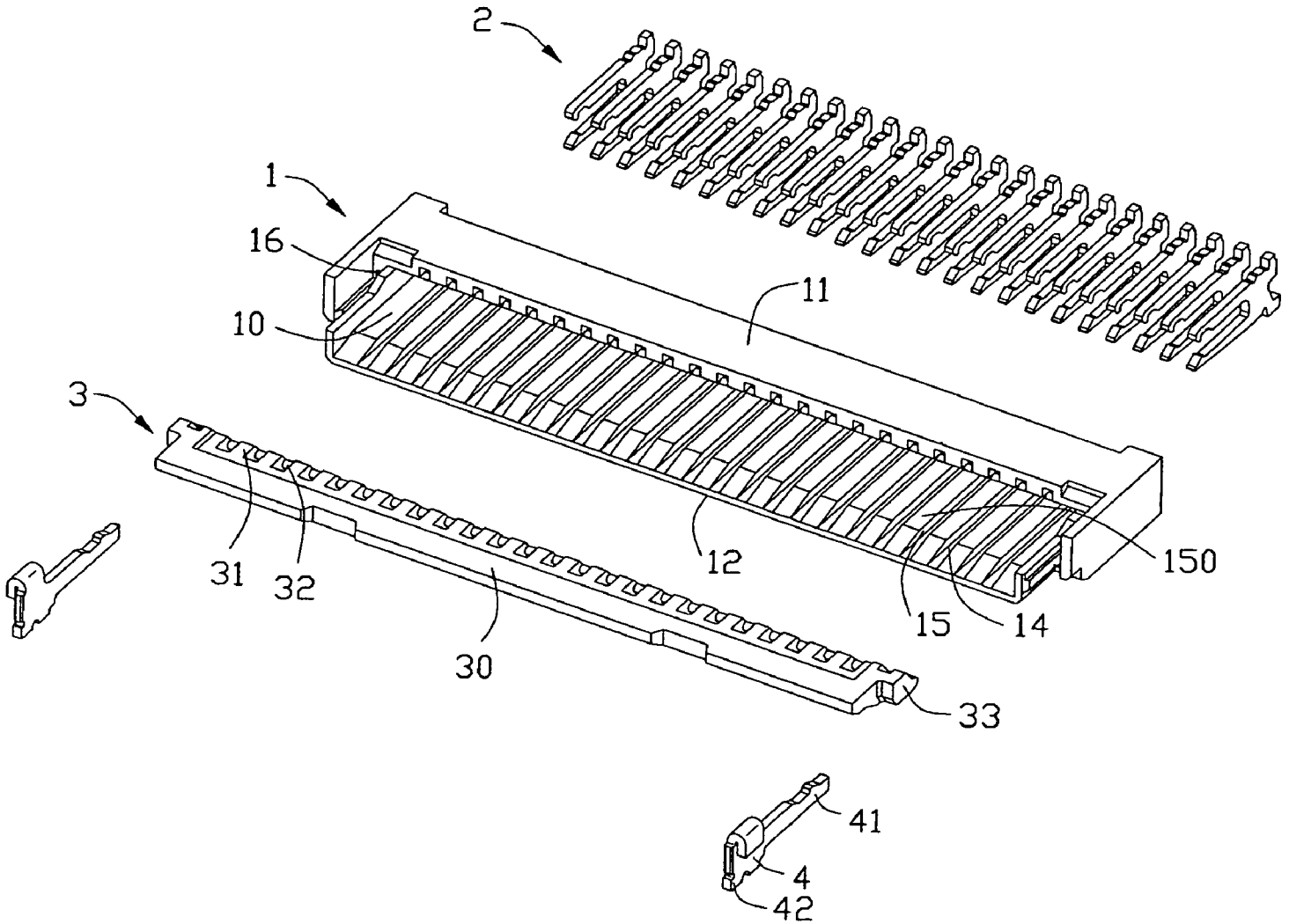
FIG. 3 is an exploded, perspective view of the electrical connector shown in FIG. 1.

Referring to FIG. 3, an electrical connector in accordance with a first embodiment of the present invention is provided. The electrical connector comprises an insulated housing 1 with a substantially rectangular shape, a plurality of electrical contacts 2 located in the housing 1, a pressing member 3 pivotally mounted to the housing 1 and a pair of support members 4 held a two longitudinal ends of the housing 1.

Figure 1:
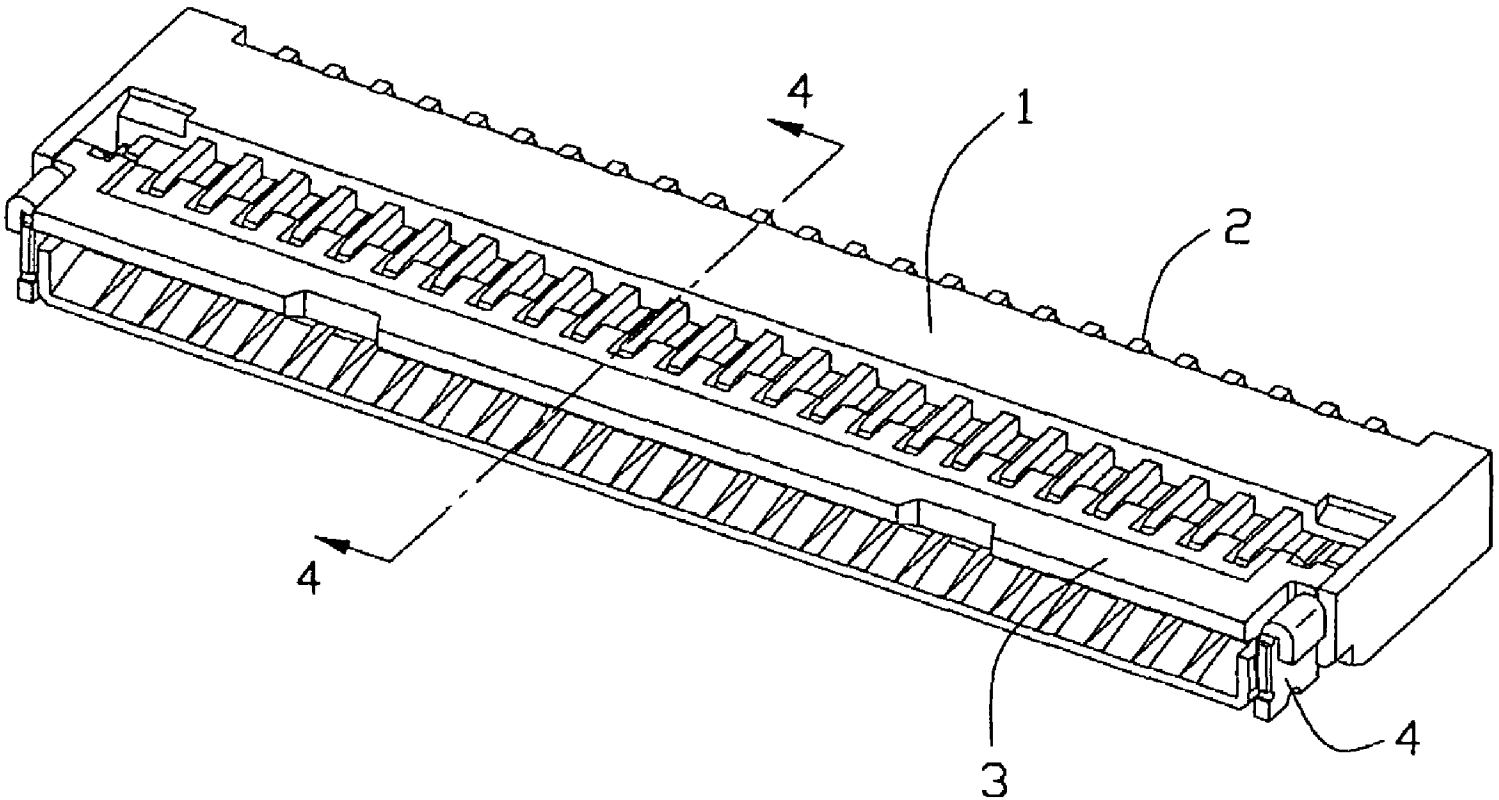
FIG. 1 is an assembled, perspective view of a electrical connector in accordance with a first embodiment of the present invention.
Figure 2:
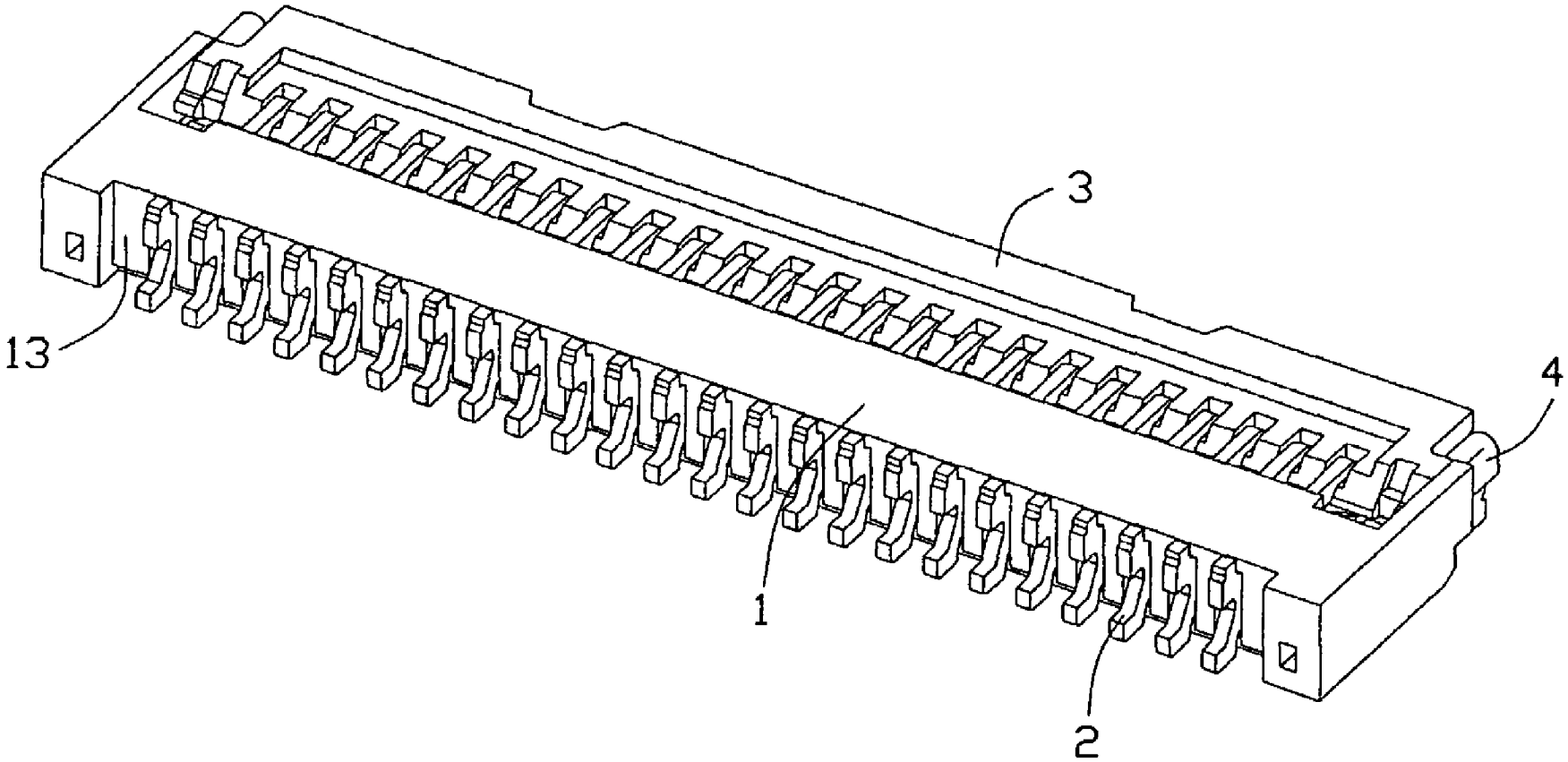
FIG. 2 is a similar view of FIG. 1, but taken from another aspect.

Referring to FIGS. 2 to 3, the housing 1 comprises a first sidewall 11, a second sidewall 12 parallel to and spacing a distance from the sidewall 11, a pair of lateral walls 13 and a receiving cavity 10 formed between the sidewalls 11, 12 and the lateral walls 13. The second sidewall 12 defines a plurality of terminal channels 14 which are in communication with the receiving cavity 10 for receiving said conductive terminals 2 therein. The second sidewall 12 has an essentially flat surface 150 and the channels 14 recesses downward from the flat surface 150. The first sidewall 11 also defines a plurality of channels 14 which are in communication with the receiving cavity 10 and arranged to corresponding to and cooperate with the channels 14 of the second sidewall 12 to receive the contacts 2 therein. Each lateral wall 13 defines a retaining hole 16 for holding the corresponding support member 4.

Figure 4:
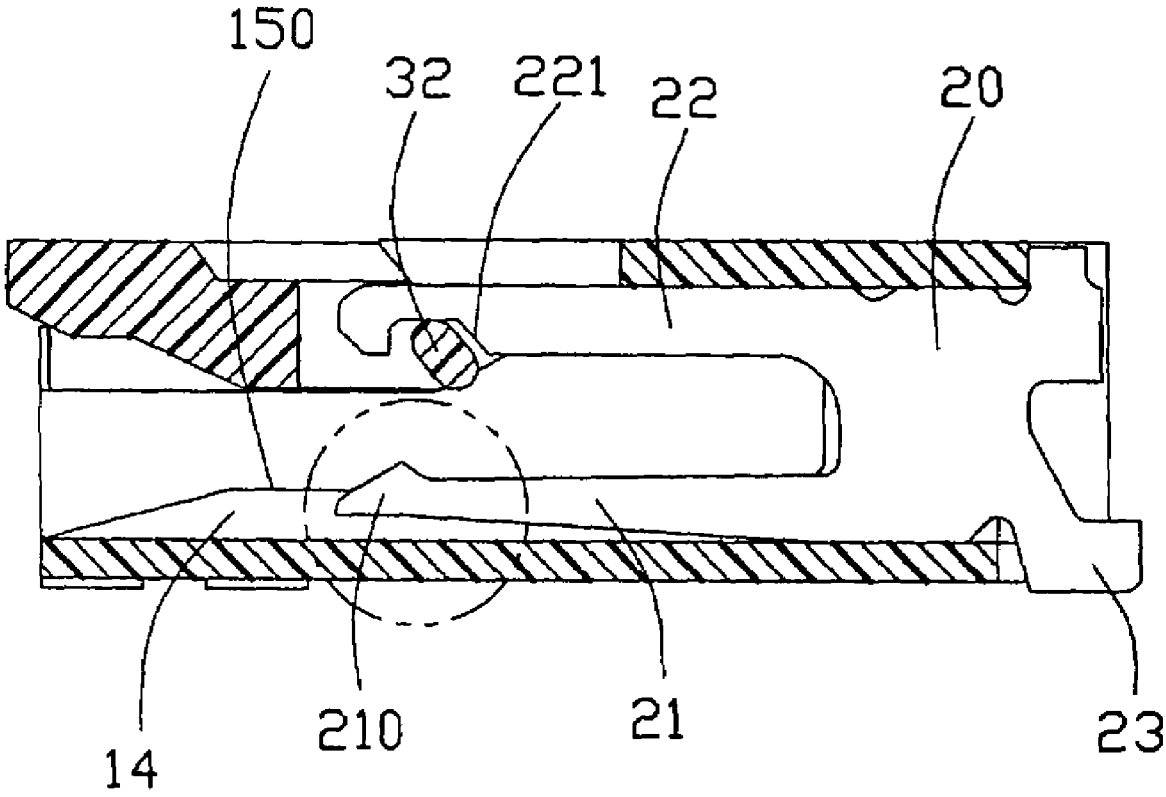
FIG. 4 is a cross-sectional view of the electrical connector, taken along the line 4-4 of FIG. 1.

Referring to FIGS. 3 and 4, each contact 2 has a resilient contact beam 21 extending along the second wall 12 to be received in the channels 14 and having a contact portion 210 projecting into the receiving cavity 10, a pivot beam 22 corresponding to and parallel to the contact beam 21 and defining a recess 221 at its distal end, a retention portion 20 connecting the contact beam 21 with the pivot beam 22, and a solder leg 23 extending opposite to the contact beam 21 from the retention portion 20.

Figure 5:
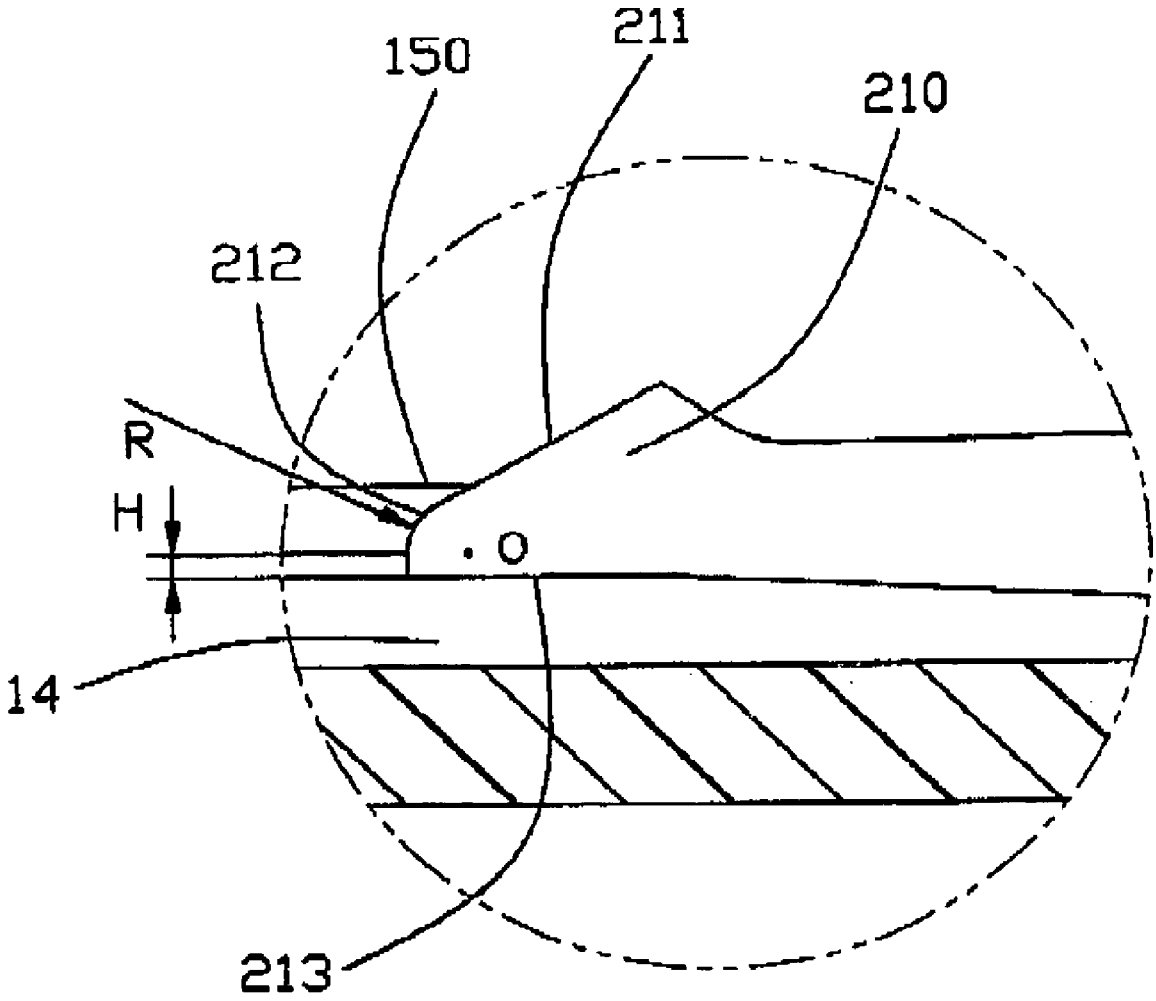
FIG. 5 is an enlarged view of a circled portion of FIG. 4.

Referring to FIGS. 4 and 5, the contact portion 210 of the contact 2 comprises a contact section exposed to the receiving cavity 10, a shadow surface 213 located at the reverse side of the contact section and neighboring on a bottom surface of the channel 14, an inclined section 211 extending forward from the contact section most portion of which are exposed outside the channel 14 for guiding a sheet-like connection member (not shown) being inserted into the receiving cavity 10 and an arced section 212 located below the flat surface 150 of the second sidewall 12 for connecting the inclined section 211 with the shadow surface 213. The distance H from the circle center (labeled as "O") of the arced section 212 to the shadow surface 213 is shorted than the radius (labeled as "R") of the arced section 212, and thus the distance between the shadow surface and the bottom surface of the channel 14 becomes longer than that of the conventional connector firstly listed in Related Arts. Namely, the space between the shadow surface and the bottom surface of the channel 14 is set enough for receiving the contact portion 210 of elastically distorted contact beam 21 without any damage to the housing 1. Namely, the arced section 212 includes a ¼ circle portion and a beeline portion which is equal to the distance H. For the arrangement of the contacts, the miniaturized electrical connector is accordingly achieved. Additionally, the contacts 2 with the arced section 212 formed on the corresponding contact beams 211 form few burrs on their cutting edges when they are stamped from metal plate.

Referring to FIG. 3, the pressing member 3 comprises an operation portion 30 and a comb-like connection portion which has a plurality of wedge portions 31 and cam portions 32 located alternatively with the wedge portions 31 in axis direction of the cam portion 32. The comb-like connection portion forms a pair of bosses 33 at its lateral sides held by the corresponding support members 4. When the pressing member 3 is mounted to the housing 1, the cam portions 32 are locked into the recesses 221 of the contacts 2. The pressing member 3 can be pivotally movable between an opened position when the sheet-like connection member is inserted into the receiving cavity 10 and a closed position when the pressing member 3 press the sheet-like connection member to electrically connect with the contacts 2.

Each support member 4 has a solder portion 42 for connection to a printed circuit board and a extended portion 41 extending from the solder portion 42 not only for holding the pressing member 3 but also for retaining the support member 4 to the remaining groove 16.

Figure 6:
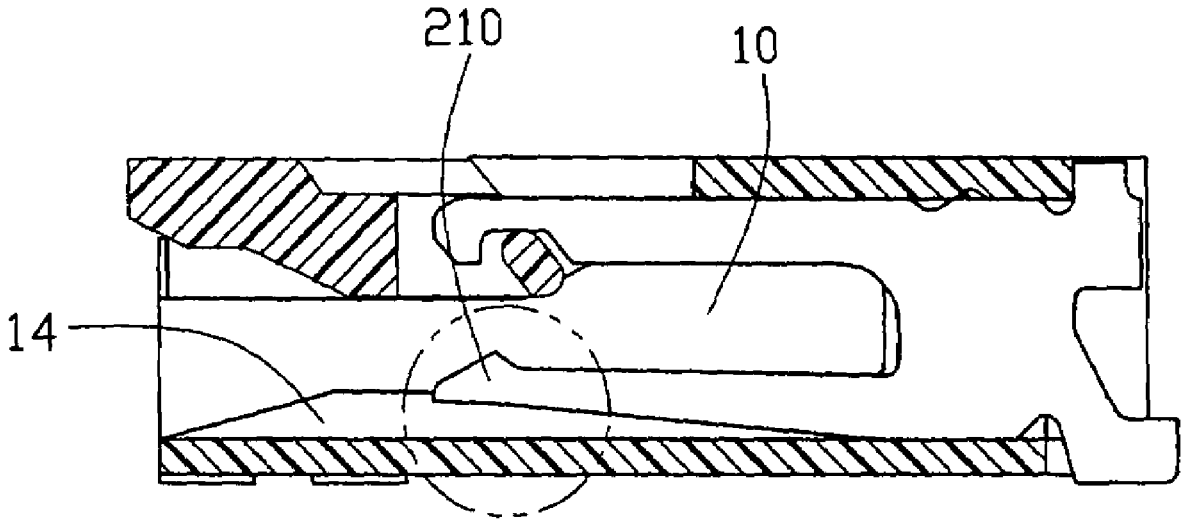
FIG. 6 is a cross-sectional view of an electrical connector in accordance with a second embodiment of the present invention.
Figure 7:
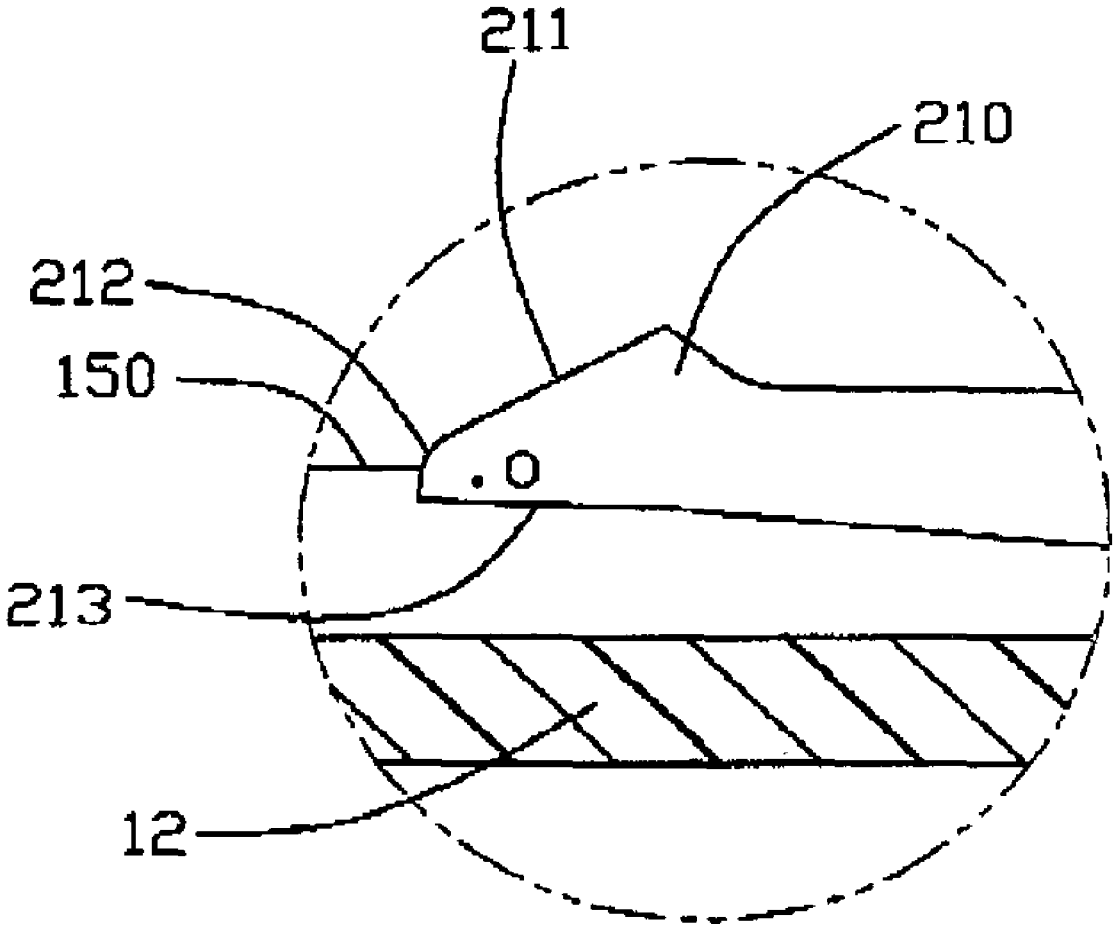
FIG. 7 is an enlarged view of a circled portion of FIG. 6.

Referring to FIGS. 6 and 7, an electrical connector in accordance with a second embodiment of the present invention is provided. The connector of the second embodiment is similar to the connector of the first embodiment except that an upper portion of the arced section 212 (called exposed arced section) is located above the flat surface 150 of the second wall 12, that is, exposed to the receiving cavity 10. Further, tangent lines of the exposed arced section are all formed at an acute angle to a direction perpendicular to the flat surface 150 so as to exert nonintervention on the insertion of the sheet-like connection member. Namely, the beeline portion lies below the flat surface.

Figure 8:
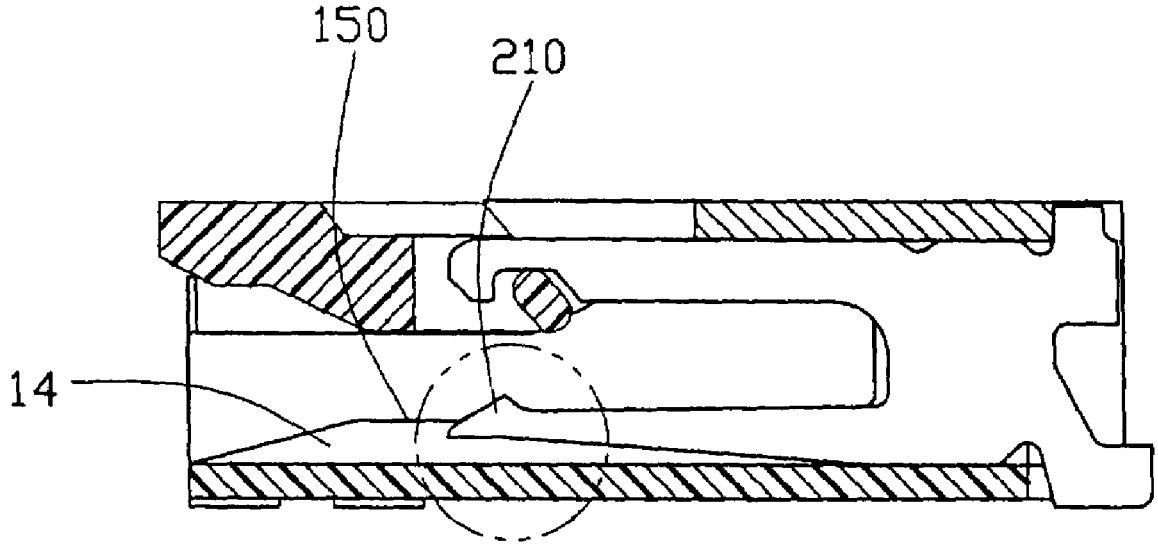
FIG. 8 is a cross-sectional view of an electrical connector in accordance with a third embodiment of the present invention.
Figure 9:
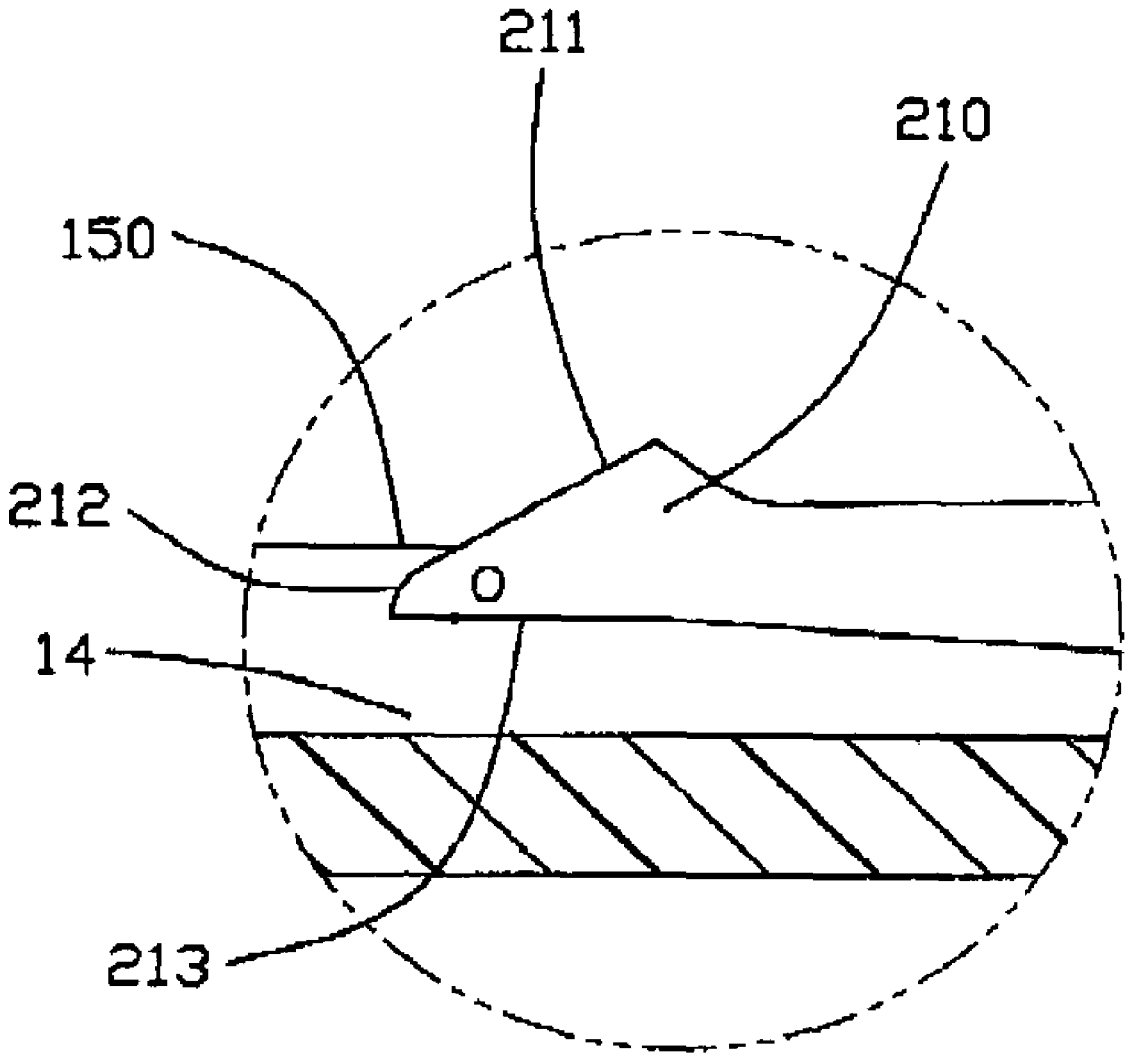
FIG. 9 is an enlarged view of a circled portion of FIG. 8.

Referring to FIGS. 8 and 9, an electrical connector in accordance with a third embodiment of the present invention is provided. The connector of the third embodiment is similar to the two above-mentioned connectors, but the circle center (labeled as "O") of the arced section 212 is arranged to be located on the shadow surface 213. Namely, the arced section 212 includes only a ¼ circle portion. This arrangement makes the housing 1 set more space for receiving the contact portion 210 of elastically distorted contact beam 21, and thus the size of the connector can be reduced accordingly. The only ¼ circle portion ensure that the whole height of the contact portion becomes smaller so that the space between the shadow surface and the bottom inside surface of the channels having a predetermined-height becomes larger to allow enough elastically shift of the contact beam, and moreover, avoid burr-forming on edges thereof.

It is noted that the contacts with the tree embodiments are suitably used in any electrical connector but not limited to the connectors disclosed above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining an elongated receiving cavity to receive a flexible printed circuit therein having a front opening communicated with an exterior, a flat surface from which a plurality of channels recessed to communicate with the receiving cavity;

a plurality of contacts disposed in channels and have contact regions extending into the receiving cavity;

each contact region comprising an inclined section facing the front opening, a flat shadow section extending from a bottom of the contact region to a front tip of the contact region, the shadow section located in the corresponding channel and an arced section at the front tip connecting the inclined section with the shadow;

wherein a joint of the arced section and the shadow section is the front tip of the contact region;

wherein the arced section is of ¼ circle and a radius center of which is on the shadow section, a distance from a circle center of the arced section to the shadow surface being shorter than radius of the arched section;

wherein each of the contacts having an upper elongated pivoted beam and a lower elongated contact beam including the contact region, the upper pivot beam and the lower contact beam being substantially parallel and extended from a retention portion having a plurality of barbs on an upper edge portion for retaining on an upper wall of the housing and a solder leg on a bottom edge portion;

wherein the length of the upper pivot beam and the lower contact beam extending from the retention portion to their front ends are substantially equal.

2. The electrical connector as claimed in claim 1, wherein the arced section is completely received in the channel of the housing.

* * * * *